US005613269A

United States Patent [19]

Miwa

[11] Patent Number: 5,613,269

[45] Date of Patent: Mar. 25, 1997

[54] RECIRCULATING TYPE CLEANER

[75] Inventor: Hirohide Miwa, Kawasaki, Japan

[73] Assignee: Miwa Science Laboratory Inc., Kanagawa, Japan

[21] Appl. No.: 416,278

[22] Filed: Apr. 4, 1995

Related U.S. Application Data

[63] Continuation-in-part of Ser. No. 139,714, Oct. 22, 1993, Pat. No. 5,457,848.

[30] Foreign Application Priority Data

Oct. 26, 1992 [JP] Japan ..... 4-287278
Dec. 24, 1992 [JP] Japan ..... 4-344307

[51] Int. Cl.[6] ..... A47L 5/14; A47L 9/28
[52] U.S. Cl. ..... 15/319; 15/346
[58] Field of Search ..... 15/319, 345, 346

[56] References Cited

U.S. PATENT DOCUMENTS

| | | | |
|---|---|---|---|
| 1,383,455 | 7/1921 | Farnsworth | 15/346 |
| 2,064,344 | 12/1936 | Good | 15/346 |
| 2,226,630 | 12/1940 | McCord | 15/346 X |
| 2,238,541 | 4/1941 | Spagnolo | 15/346 X |
| 2,592,710 | 4/1952 | Kirby | 15/319 |
| 3,075,227 | 1/1963 | Bowles | 15/346 |
| 3,268,942 | 8/1966 | Rossnan | 15/346 |
| 3,694,848 | 10/1972 | Alcala | 15/346 |
| 4,207,650 | 6/1980 | Crise | 15/346 |

FOREIGN PATENT DOCUMENTS

| | | | |
|---|---|---|---|
| 977910 | 11/1975 | Canada | 15/346 |
| 1542802 | 9/1968 | France | 15/346 |
| 2455878 | 1/1981 | France | 15/346 |
| 2218351 | 11/1973 | Germany | 15/346 |

*Primary Examiner*—Chris K. Moore
*Attorney, Agent, or Firm*—Pollock, Vande Sande & Priddy

[57] ABSTRACT

In a recirculating type cleaner, a jet nozzle is provided within a dust collecting head formed in the bottom face of the housing, the after-flow air from the suction fan is supplied through a recirculating tube to the jet nozzle. In the after-flow of the fan is provided a branch valve which is controlled by a controller to set the air recircuration ratio at a desired value suitable for any cleaning mode.

3 Claims, 3 Drawing Sheets

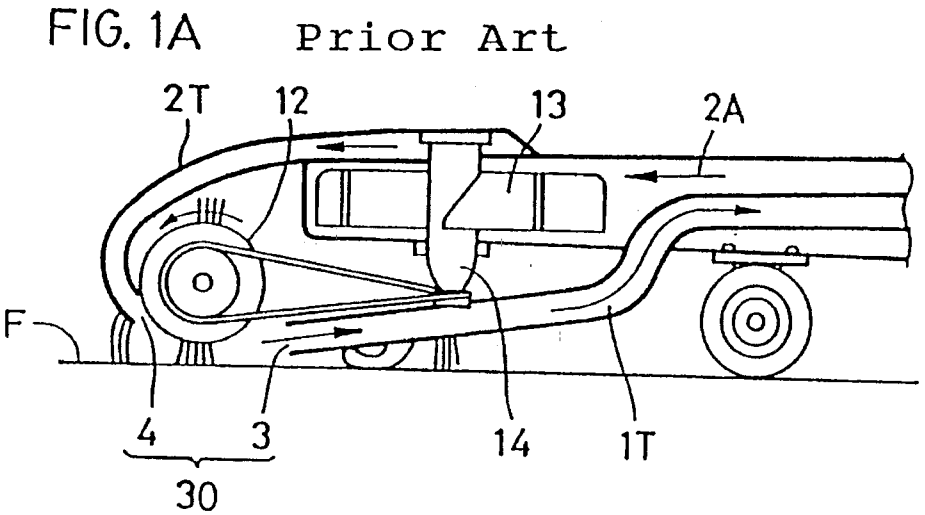
FIG. 1A Prior Art
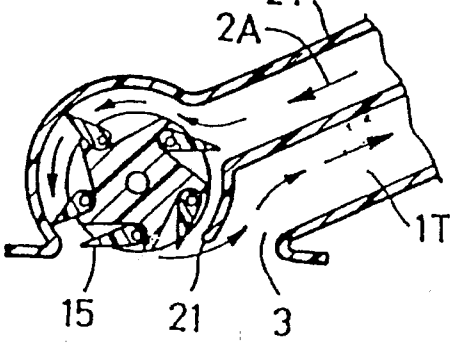
FIG. 1B Prior Art
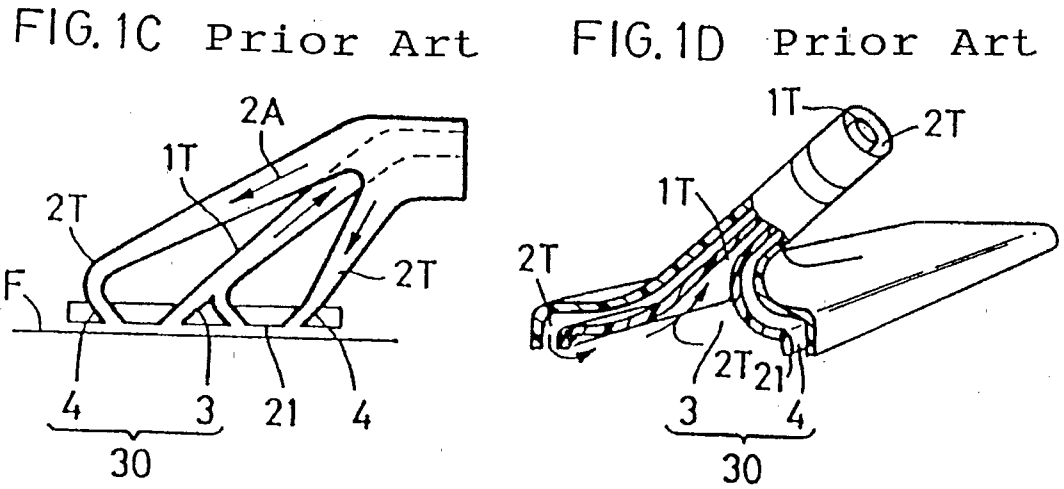
FIG. 1C Prior Art
FIG. 1D Prior Art
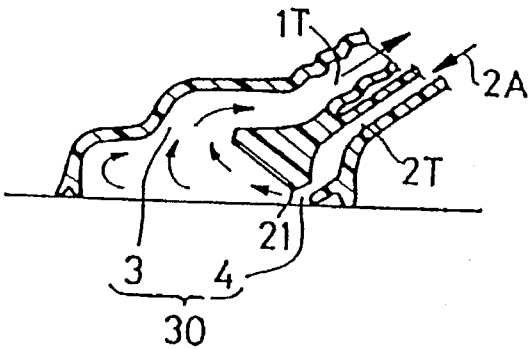
FIG. 1E Prior Art FIG. 2A1
Prior Art
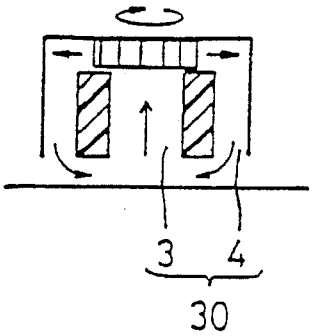
FIG. 2A2
Prior Art
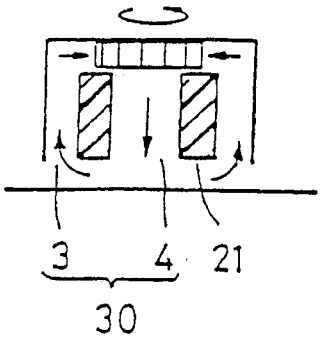
FIG. 2B Prior Art
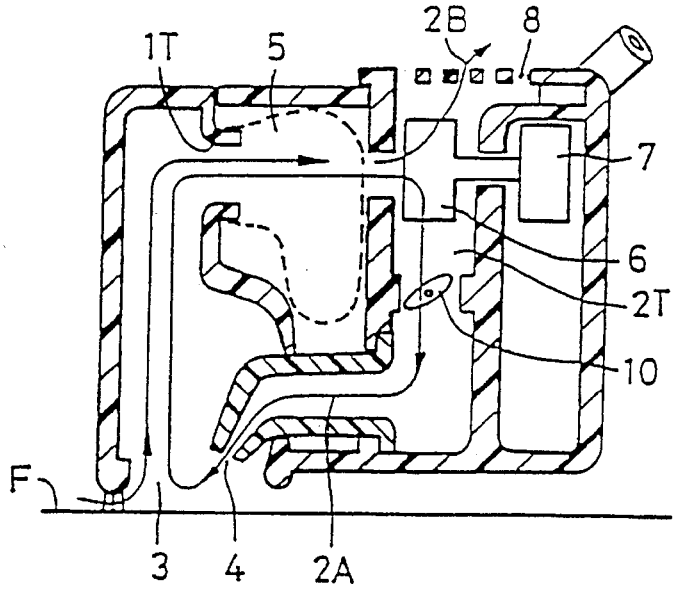
FIG. 2C Prior Art
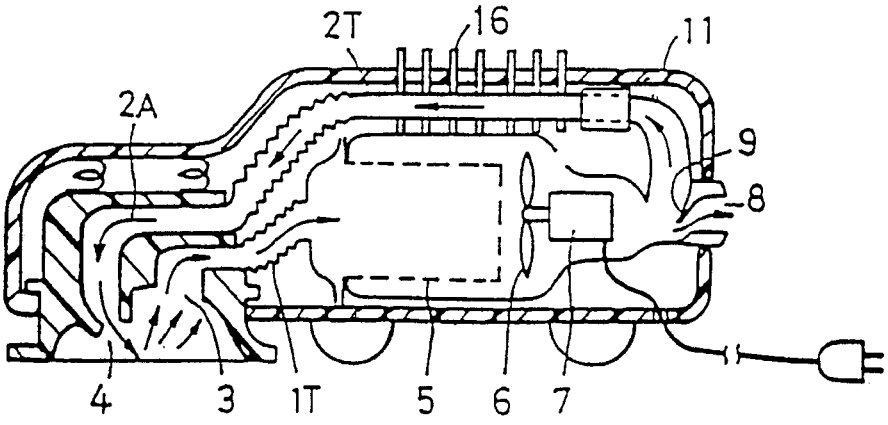

RECIRCULATING TYPE CLEANER

CROSS-REFERENCE TO RELATED APPLICATION

The present application is a continuation-in-part of Miwa, U.S. patent application Ser. No. 08/139,714, filed Oct. 22, 1993 for "Recirculating type Cleaner"; now U.S. Pat. No. 5,457,848, issued Oct. 17, 1995.

TECHNICAL FIELD

This invention relates generally to an electric cleaner and particularly to a recirculating type cleaner in which the after-flow of the suction fan (as will be referred to as "after-flow" hereinafter) is recirculated back to the suction port to utilize the energy of the after-flow to thereby reduce the aural noise to the exterior and prevent fine dusts from being exhausted to the exterior as well as improving the cleaning efficiency per unit electric power.

BACKGROUND ART

Various approaches to making use of the after-flow energy have been proposed by the prior art as illustrated in FIGS. 1A–1E and 2A–2C.

Approach 1:

As schematically shown in FIG. 1A, for example, this approach is to employ the after-flow 2A to rotate a turbine impeller 1B which in turn rotates a rotary brush 12 for removing dust, dirt or refuse. An example of this approach is disclosed in Japanese utility model publication Kokoku No. 39-36553 published on Jul. 7, 1962.

Approach 2:

As schematically shown in FIG. 1B, for example, this approach is characterized by driving a beating vibratory means 15 by the after-flow 2A. An example of this approach is disclosed in Japanese patent publication Kokai No.3-162814 published on Jul. 6, 1990.

Approach 3:

As illustrated in FIG. 1C or 1D, for example, this approach is to direct the after-flow 2A, as jets if desired, in a direction generally parallel to the surface F being cleaned to be drawn into an opposing suction port 3 in which the flow is created by both the forcing positive pressure and the suction rather than the suction alone from the atmosphere as in the non-recirculating type cleaner. The arrangement of FIG. 1C is disclosed in the aforesaid Japanese utility model publication Kokoku No. 39-36553 and Japanese utility model publication Kokoku No. 43-22616 (published on Oct. 5, 1964). The arrangement of FIG. 1D is shown in Japanese patent publication Kokai No. 48-46157 (published on Oct. 1, 1971).

Approach 4:

As illustrated in FIG. 1E or FIG. 2B, 2C for example, this approach is to discharge the after-flow 2A in the form of a jet against the surface F being cleaned at an angle of 0° to 60° relative to the surface F to blow up the dust to be suctioned into an opposing suction mouth 3. The arrangements of FIG. 1E, FIG. 2B and FIG. 2C are disclosed in Japanese patent publication Kokai No. 48-101764 (published on Apr. 8, 1972), Japanese utility model publication Kokai No. 60-188553 (published on May 24, 1984) and Japanese patent publication Kokai No. 3-162814, respectively.

Approach 5:

U.S. Pat. No. 3,268,942, for example, teaches providing a recirculating flow outlet within the region of a dust collecting port, the outlet comprising a number of jet nozzles, and blowing the jet at an angle of approximately 90 deg. relative to the surface F to be cleaned, whereby the dust entrapped in grooves or between the root portions of the carpet piles may be effectively removed.

In the approaches 3 and 4, the configurations of the dust collecting port 30 (comprising an outlet 4 and a suction port 3) may take various forms:

(A) The suction port 3 is most often located within the region of the outlet 4 as illustrated in FIGS. 1C, 1D and 2A1 (Japanese patent publication Kokai No. 58-175528). In some cases, however, the dust collecting port 30 may comprise a one-sided outlet 4 and a one-sided suction port 3 as shown in FIG. 1A, 1E and 2B.

(B) As illustrated in FIG. 2A2 (Japanese patent publication Kokai No. 58-2175528), a single outlet 4 may be disposed within a suction port 3.

(C) In the arrangements of FIGS. 1C, 1D, 1E and 2A1, 2A2, the end surface 21 of the boundary wall between the outlet and suction regions is generally parallel to the surface F to be cleaned, and planar and smooth.

(D) As illustrated in FIGS. 2C, 2A1 and 2A2, the end surface of the outer peripheral wall of the suction region may be generally parallel to the surface F, and planar and smooth.

In the aforesaid prior art cleaners except those shown in FIGS. 2B and 2C, the recirculating ratio (the amount of the flow discharged at the dust collecting port divided by the amount of the after-flow of the fan motor) appears to be 100% as far as it may be seen from the constructions shown.

In the arrangement shown in FIG. 2B a regulating valve 10 is disposed in the recirculating path 2T after the after-flow is divided into a recirculating flow 2A and an exhaust flow 2B. With this construction, it is presumed that the recirculating ratio may not exceed 50% even with the recirculating path being fully open. The regulating valve 10 may be operated either manually or by the negative pressure at the suction port.

World (Canadian Patent CA 977910) discloses employing a recirculation ratio less than 100% while discharging 5% of the air suctioned to the atmosphere in order to maintain a negative pressure inside the dust collecting port. But, the recirculation ratio is fixed. In the arrangement shown in FIG. 2C, a two-way valve 9 is disposed at the branch point. With this construction, the recirculating ratio may be varied from 100% to 0% but is set in a semi-fixed manner for the primary purpose of cooling and keeping the vicinity of the outer boundary of the dust collecting port in negative pressure. Further, Bordini (French Patent 1,542,802) illustrates the use of a short-circuit valve in the recirculating type dust collecting port for selectively connecting the suction path with the recirculating path in a short-circuit manner, the arrangement being such that the short-circuit valve may be actuated to prevent the dust from being blown up when the cleaning port comes in proximity to the surface being cleaned. It is also proposed that the short-circuit valve be actuated intermittently to cause the air jet to impact against the surface being cleaned during the cleaning operation. While the efficiency in utilization of the after-flow energy has been enhanced by the approach 5, the prior art cleaners as described hereinabove still have the following subjects to be solved:

Subject 1:

It is proposed as illustrated in FIG. 2C and as per Japanese patent application Kokai No.3-152814 by Miwa and Canadian Patent CA 977910 to World that the recirculation ratio be set at a level lower than 100% for the purpose of cooling the motor as well as preventing the dust from being scattered around a dust collecting head. On the other hand, the cleaning efficiency is higher with the recirculation ratio closer to 100%, as will be explained hereinafter. Accordingly, the operation should take place at an optimal recirculation ratio. However, a greater suction force may sometimes be needed as when the dust is relatively heavy and fine, or relatively less suction force may be needed when the surface to be cleaned is a smooth flooring, or it may be desired to strongly vacuum ticks from underneath the outer surface of 'tatami' mats (Japanese straw made mats) or carpets. Further, it may be desirable to have a stronger jet in order to clean a long-piled carpet, for example. For this reason, it is desirable to control the recirculation ratio (the maximum suction at a ratio of 0% and the strongest jet at a ratio of 100%) in stepwise fashion or continuously.

FIG. 2B is an example of the conventional recirculation ratio variable system where the recirculating ratio may be varied in an ON-OFF manner or continuously. It is presumed that such a system may raise the recirculation ratio up to 50% at highest, which is insufficient to provide a satisfactory efficiency because branching comes first and later only the recirculation flow is controlled. The system shown in FIG. 2C is capable of approximately 100% to 0% regulation, but the regulation is primary for the purpose of cooling the motor fan and preventing dust scatter by the jet with the regulating valve 9 being set in a semi-fixed manner. The World patent does not disclose the specific construction of the discharge valve, the setting of which is effected in a semi-fixed manner. None of the three examples just described above permits the operator to control the recirculation ratio over a wide range and in a convenient manner during the cleaning operation.

Subject 2:

While the Bordini patent proposes providing a valve for selectively connecting the suction path with the recirculating path in a short-circuit manner, the valve being adapted to be actuated either manually or electrically to prevent the recirculating jet from scattering the dust by short-circuiting when the cleaning port comes in proximity to the surface being cleaned, the valve is operated in an ON-OFF manner, so that when actuated, it completely terminates the functions of the cleaning head (discharging and suctioning the air). That is, it is impossible to operate the cleaning head at a desired recirculating ratio. Even if the opening of the short-circuit valve were made continuously variable, the control of the opening of the short-circuit valve would change the flow to and from the cleaning head but not change the ratio of discharging to sucking (recirculation ratio) because no means are provided for branching the after-flow to be exhausted. In other words, the recirculation ratio is always 100% regardless of the opening area of the short-circuit valve the ratio. Thus, it would not be possible to vary the ratio of discharging to sucking at the cleaning head while making the full use of the flow output of the fan motor. To effect adjustment of the recirculating ratio, when required, another device must be provided separately in addition to the short-circuit valve.

SUMMARY OF INVENTION

A first object of this invention is to provide a recirculating type cleaner in which the recirculation ratio may be varied over a in wide range depending on modes of operation for the type of surfaces to be cleaned (smooth floors, carpets etc.), the objects to be removed (beans, small metal fittings, etc.), and others such as cleaning of shelves, furniture, wall surfaces and the like other than floor surfaces, moving of the cleaner from one to another location, tick-killing, etc.

A second object of this invention is to provide a recirculating type cleaner in which the scattering of dust by a blowing-out jet may be prevented automatically and attracting the nearby dust under the collecting head when the cleaning head is lifted away from the surface being cleaned.

According to the present invention, a jet nozzle is disposed within a dust collecting head of the cleaner, and the after-flow of the suction fan is supplied through a recirculating tube to the jet nozzle to blow the air against the surface to be cleaned. A branch valve is provided in the after-flow from the fan to branch the exhaust air to the outside of the housing from the after-flow partially or entirely. The opening degree of the branch valve is controlled by a controller to set the recirculation ratio of the air at a desired value in the range of 100% to 0%.

The above arrangement may be provided with a mode selection switch to select the mode of operation, in accordance with the opening degree of the branch valve. Some modes may be identified by a sensor, then automatic mode change will be possible.

The above arrangement may be provided with a floor sensor and a controller to control the ON/OFF of the fan motor in response to the detection output of the sensor though the functions of the dust collecting head becomes dead.

Firstly, according to one aspect of this invention, for the various surfaces to be cleaned, the various cleaning modes may be effected by providing means for varying the recirculation ratio in a range of 100% to 0% and the means is realized by a branch valve preferably through a control such as a manually operable mode selection switch or the like, rather than a manual operation of the valve. The recirculation ratio may be varied over in a wide range of 100% to 0% by providing a branching means such as a branch vane at the branch point and moving the vane between its open and closed positions. In an embodiment, the rotating shaft of the vane is connected with a motor via a transmission, the arrangement being such that the motor may be turned on and off in a certain step by a switch provided at the grip handle of the cleaner, whereby the recirculation ratio may be readily changed in stepwise fashion or continuously during the cleaning operation. Secondly, according to this invention, means may be conveniently and inexpensively provided for either reducing or zeroing the blow-out flow (jet) by lowering the recirculation ratio with the aforesaid provision or by turning the fan motor in response to a floor sensor when the dust collecting head is lifted away from the surface to be cleaned. Hence, the dust is prevented from being blown up when the dust collecting port comes close to the surface to be cleaned and nearby dust is attracted under the dust collecting head at the reduced recirculating ratio. The operation may be returned to the normal mode when the dust collecting head is placed on the surface to be cleaned in normal attitude.

BRIEF DESCRIPTION OF THE DRAWINGS

These and other more detailed and specific objects and features of the present invention will be more fully disclosed in the following specification with reference to the accompanying drawings, in which:

FIG. 1A is a cross-sectional view of a prior art recirculating type cleaner showing a pertinent part thereof;

FIG. 1B is a cross-sectional view of another prior art recirculating type cleaner showing a pertinent part thereof;

FIG. 1C is a cross-sectional view of still another prior art recirculating type cleaner showing a pertinent part thereof;

FIG. 1D is a cross-sectional view of yet another prior art recirculating type cleaner showing a pertinent part thereof;

FIG. 1E is a cross-sectional view of another prior art recirculating type cleaner showing a pertinent part thereof;

FIGS. 2A1 and 2A2 are cross-sectional views of still another prior art recirculating type cleaner showing a pertinent part thereof;

FIG. 2B is a cross-sectional view of another prior art recirculating type cleaner showing a pertinent part thereof;

FIG. 2C is a cross-sectional view of yet another prior art recirculating type cleaner showing a pertinent part thereof.

DETAILED DESCRIPTION OF THE PREFERRED EMBODIMENTS

Figure 3:
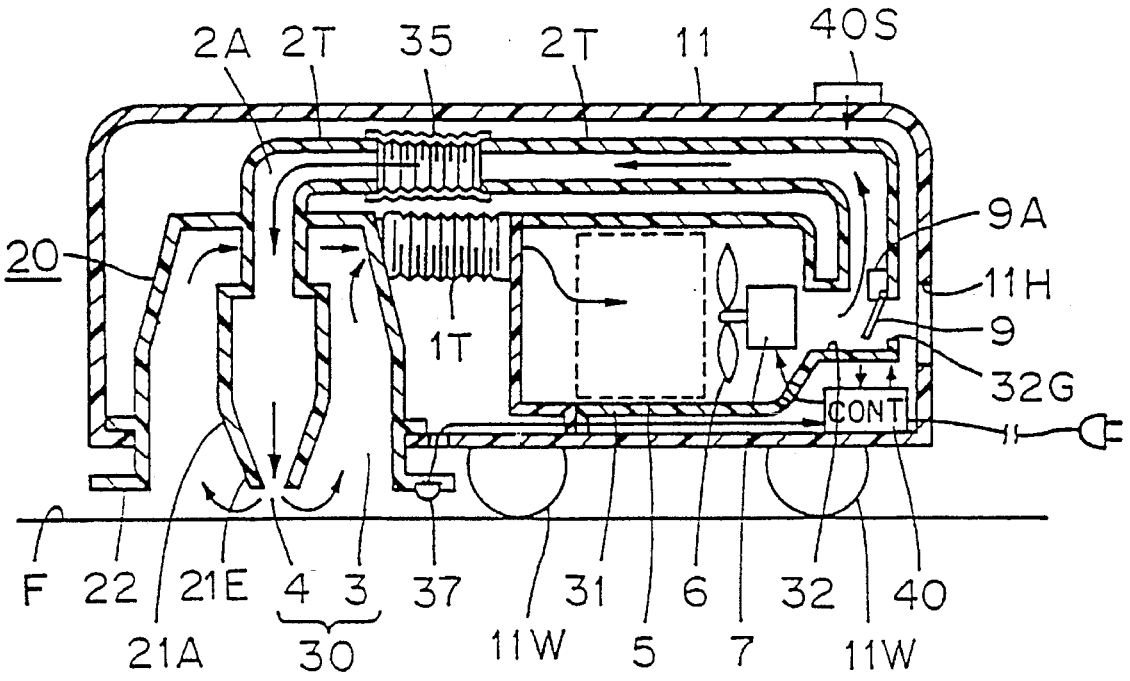
FIG. 3 is a cross-sectional view of principal parts of an embodiment of the recirculating type cleaner according to the present invention.

Referring to FIG. 3, a first embodiment of the recirculating type cleaner according to the present invention is shown in a vertical cross-sectional view. In this embodiment the dust collecting head 20 is inserted in a cleaner housing 11 from the bottom opening thereof and mounted in the housing. The head 20 comprises a central jet nozzle 21A terminating in an outlet for discharging recirculating flow at the lower end thereof. The upper end of the jet nozzle 21A is connected via a recirculating tube 2T with a rear conduit 32 leading from a dust collecting chamber 31. Mounted in the dust collecting chamber 31 adjacent the rear conduit 32 is a motor 7 which drives a fan 6 to create a vacuum or a negative pressure in the chamber A filter 5 is accommodated in the chamber 31 which is in fluid communication with a suction port 3 of the dust collecting head 20 via a suction tube 1T on the side of the open forward end of the filter 5.

Formed through that portion of the rear conduit 32 wall opposing the fan 6 is an opening 32G, in opposing relation to which an exhaust port 11H is formed through the side wall of the housing 11. The opening 32G is adapted to be closed and opened by a pivotable recirculating flow branch valve 9 which may be driven and set at any desired opening angle as by a solenoid- or motor-operated actuator 9A under the control of a controller 40. With the opening 32G completely closed by the branch valve 9, the recirculation ratio is 100% (full recirculation mode), while with the branch valve 9 turned to close the recirculating tube 2T, the recirculation ratio is 0% (pure suction mode). Other branching means are available besides the shown example. For example, just an area control of hole 32G instead of branch valve 9 effects well, though perfect 0% of recirculation ratio cannot be obtained even at the full opening of the hole 32G. Many small holes can be used instead of the single one large opening 32G. Several combinations of an ON-OFF shutter and a various opening area hole for stepwise control can also be used. A mode selecting switch 40S is provided on the top surface of the housing 11 or the handle grip (not shown) of the cleaner and electrically connected with the controller 40. The operator may use the mode selecting switch LOS to select the operation mode of the cleaner depending on the type of the surface to be cleaned (wooden flooring, carpets, 'tatami' mats, undulating surfaces, etc.), for example. The controller 40 drives the actuator 9A to set the branch valve 9 at an opening (angle) suitable for a selected operation mode, so that the cleaner may operate at a recirculation ratio suitable for the selected operation mode.

As shown in FIG. 3, the jet nozzle 21A is tapered in cross section toward the lower end to define a constricted orifice such that the direction of discharge is approximately normal to the lower end plane of the suction port 3 so as to produce a jet in a direction perpendicular to the surface F to be cleaned. The peripheral wall of the jet nozzle 21A defines a boundary wall to separate the suction port 3 from the outlet 4.

The outlet 4 may comprise a single jet as shown in FIG. 3 or a plurality of jets. The outer peripheral wall of the dust collecting head 20 separates the outlet 4 from the atmosphere. The lower end of the outer peripheral wall is turned outwardly to define a flange 22 extending parallel to the the surface or floor F to be cleaned.

Wheels 11W support the cleaner so as to maintain a spacing between the flange 22 and the surface F to be cleaned. The distance between the flange 22 and the surface F may be automatically adjusted by moving the dust collecting head 20 vertically by a drive means (not shown). Such drive means may be actuated under the control of a controller 40 which operates in response to a signal representing the said distance as detected by an optical or ultrasonic sensor 37. The sensor 37 may be mounted on the flange 22 as illustrated. The recirculating tube 2T and suction tube 1T may include flexible joint tubes such as 35 intermediate their opposite ends. Following are the results of experiments conducted on the dust collecting head as described in the approach 5 in reference to FIG. 3 (which is a cross-sectional view taken vertically through the recirculating tube 2T). These experiments were conducted on a recirculating type cleaner which was modified from a commercially available non-recirculating type cleaner operable at an input power of 900 W and adjustable in power between seven steps. The discharge angle of the recirculated jet relative to the floor surface was about 90°. The dust collecting head was constructed as illustrated in FIG. 3. A cleaning test was made on a floor having a straight groove extending at 45° with respect to the sweeping direction of the cleaner according to JIS C-9108. The amount of sand removed from the groove was measured. With the cleaner according to this invention the amount of sand removed per unit air power was 2.4 times as much as that of the conventional cleaner. In addition, an increase by a factor of 1.6 in the electric power to air power conversion efficiency can be expected if a smaller fan motor is optimized at the experimented power, where the 900 W fan motor was operated at reduced rating. It was thus found that in total the cleaning amount per unit electric power or the cleaning efficiency was 3.84 times as much as that of the conventional cleaner.

Another test was made on a carpet having sand scattered on the carpet wool, and it was found that up to 2 times as much cleaning efficiency was obtained.

These values of cleaning efficiency were achieved in the case where the recirculation ratio was near to 100%, in which the temperature rise of the fan motor might pose a problem. However, a satisfactory cleaning efficiency can be realized even if the power to the fan motor is reduced to about ⅓.84, for example. Accordingly, it is possible to keep the temperature rise of the fan motor below the specified level of standard. In the embodiment of FIG. 3, the region of suction port 3 is under the influence of suction. When the recirculation ratio is less than 100%, the surrounding air equal to the reduced amount from 100% is correspondingly drawn in through a gap between the flange 22 and the surface F being cleaned. The air recirculating in a closed loop is thus prevented from blowing out from the dust collecting head 20 and scattering the nearby dust. It is further required to reduce the recirculation ratio in order to cool the fan motor.

In the embodiment as described above, when the dust collecting head 20 is facing the surface F being cleaned, the jet will impact on the surface F being cleaned and part to and fro to be drawn into the suction port 3. However, when the head 20 is lifted away from the surface F, the air jet will spout far in the air without being obstructed by the surface F, which may undesirably blow the nearby dust away. When the head 20 is lifted away from the surface F, therefore, it is desirable to turn off the fan motor, or to turn down the recirculation ratio (to a value including 0%) by means of the branch valve 9 shown in FIG. 3, to deactivate the dust collecting head, or to change the dust collecting head to a suction mode of operation. After holding the head in its normal cleaning attitude, the fan motor or recirculation ratio can return to the normal operation. To this end, the floor sensor 37 may be mounted on the flange 22 to detect the distance of the flange 22 from the surface F to be cleaned so that the power supply to the fan motor 7 may be out off or the branch valve 9 be operated by the actuator 9A under the control of the controller 40 in response to the detected distance.

It will now be explained by specific examples that the foregoing construction may be easily realized by the techniques and component parts widely known or conventionally used in the art.

The sensor 37 may be a conventional floor surface sensor mounted on the nozzle (power nozzle) having a motor-driven brush at the dust collecting port. In the power nozzle type cleaner, a floor surface sensor is provided for stopping the brush motor while the power nozzle is turned upward so that a child's fingers, for example, may not be injured by the rotating brush. Such floor surface sensors are usually microswitches activated by a wheel or slider contacting the floor via spring. Such a mechanically contacting sensor may be used as a sensor 37.

Other examples of the floor surface sensor which may be used for the purpose of this invention include various types of non-contact proximity switches employed for the security purposes or at factories. The most commonly used one of the various systems is as follows. An infrared LED radiates infrared light modulated by a particular carrier frequency and/or a sequence of digital codes, and the light is reflected from a nearby object and received by a silicon photo diode. Eliminating surrounding noise light rays by utilizing an appropriate modulation, the light reflected from the nearby object can be identified. The amount of light detected varies in an analog-like manner such that the closer the object is, the more the detected light while the farther the object, the less the light detected.

Although the controller 40 only needs to effect simple ON-OFF control in order to control the motor 7 or branch valve 9 in response to the output, the controller 40 may preferably have a built-in microcomputer, for example to make it possible to control the opening of the branch valve 9 depending on the operation mode selected by the selector switch 40S. In that case, the microcomputer produces a drive signal for actuating the valve and/or a control signal for controlling ON-OFF operation of the motor 7 in response to various input signals in accordance with a built-in operation control program. It is easy for those having an ordinary knowledge in the art to make such arrangement as required.

Solenoids or small motors which may be used as an actuator 9A for driving the branch valve 9 are commonly employed to electrically control various pneumatically operated machines at factories, and they are widely used at chemical factories as well.

It is also a common practice in the art of automatic control with various analog sensors at chemical factories to convert an analog output of a proximity sensor in accordance with a particular function by a microcomputer so as to vary the opening of a valve in an analog-like manner (continuously or in stepwise fashion). While it is of course possible in embodiments of this invention to incorporate a microcomputer in the controller 40 to vary the opening of the recirculating flow branch valve with a motor in an analog-like manner, it is also feasible to produce signals for several distinct degrees of opening by, for example, some combinations of switches and to resistors, and select one of them in accordance with the mode selected by the switch 40S.

ADVANTAGES OF THE INVENTION (1) It is possible to select an appropriate recirculation ratio depending on the type of surfaces to be cleaned (smooth floors, carpets etc.) and the operating mode of the cleaner (cleaning of shelves, furniture, wall surfaces and the like other than floor surfaces, moving of the cleaner from one to another location, tick-killing, etc.).

(2) It is conveniently and inexpensively possible to prevent the dust on the floor from being scattered and further attract the nearby dust under the dust collecting head when the cleaning head is lifted away from the floor surface by utilizing the recirculation ratio-reducing means or turning off the fan-motor as described hereinabove.

What is claimed is:

1. A recirculating type cleaner comprising:

a housing containing a dust collecting chamber therein;

a dust collecting head connected to said housing;

a jet nozzle provided within said dust collecting head for discharging an air jet;

a fan positioned at one end of said dust collecting chamber for drawing air from the dust collecting chamber and sending out air as after-flow of said fan;

a suction tube connecting said dust collecting head with said dust collecting chamber;

a recirculating tube supplying the after-flow of said fan to said jet nozzle;

an exhaust opening for communicating the after-flow side of said fan to the exterior of the housing;

a branching means for dividing the after-flow into an exhaust flow to be sent out through said exhaust opening and a recirculating flow to be sent to said jet nozzle through said recirculating tube;

a mode selecting means for generating, in response to manual operation for the selection of one of a plurality of operation modes, a selection signal indicating the selected operation mode; and control means connected to said mode selecting means for electrically controlling, in response to said selection signal, said branching means to vary the recirculation ratio in stepwise fashion to one of a plurality of predetermined recirculation ratios in accordance with the selected operation mode.

2. A recirculating type cleaner comprising:

a housing containing a dust collecting chamber therein;

a dust collecting head connected to said housing;

a jet nozzle provided within said dust collecting head for discharging an air jet;

a fan positioned at one end of said dust collecting chamber for drawing air from the dust collecting chamber and sending out air as after-flow of said fan;

a suction tube connecting said dust collecting head with said dust collecting chamber;

a recirculating tube supplying the after-flow of said fan to said jet nozzle;

an exhaust opening for communicating the after-flow side of said fan to the exterior of the housing;

a branching means for dividing the after-flow into an exhaust flow to be sent out through said exhaust opening and a recirculating flow to be sent to said jet nozzle through said recirculating tube;

a floor surface sensing means for detecting whether or not the distance between said dust collecting head and the floor surface is within a predetermined range and producing a detection signal representing the detection result; and control means connected to said floor surface sensing means and responsive to said detection signal for electrically setting said branching means to a lower one of a plurality of predetermined recirculation ratios to increase suction of the dust collecting head when said distance is greater than said predetermined range.

3. A recirculating type cleaner comprising:

a housing containing a dust collecting chamber therein;

a dust collecting head connected to said housing;

a jet nozzle provided within said dust collecting head for discharging an air jet;

a fan positioned at one end of said dust collecting chamber for drawing air from the dust collecting chamber and sending out air as after-flow of said fan;

a suction tube connecting said dust collecting head with said dust collecting chamber;

a recirculating tube supplying the after-flow of said fan to said jet nozzle;

an exhaust opening for communicating the after-flow side of said fan to the exterior of the housing;

a branching means for dividing the after-flow into an exhaust flow to be sent out through said exhaust opening and a recirculating flow to be sent to said jet nozzle through said recirculating tube;

a control means for electrically controlling the branching means to thereby vary the recirculation ratios between at least two ratios in accordance with mode of operation; and floor surface sensing means for detecting whether or not the distance between said dust collecting head and the floor surface is within a predetermined range and for providing a detection signal to said control means, said control means being operative in response to said detection signal to stop said fan and to render the dust collecting head inactive when the detection signal indicates that said distance is greater than the predetermined range.

* * * * *